United States Patent [19]

Kluczynski et al.

[11] 4,206,681

[45] Jun. 10, 1980

[54] PERCUSSION INSTRUMENT

[75] Inventors: Roman Kluczynski; Herbert Miss, both of Bad Berlenburg, Fed. Rep. of Germany

[73] Assignee: Fa. Johs. Link KG, Bad Berleburg, Fed. Rep. of Germany

[21] Appl. No.: 24,315

[22] Filed: Mar. 27, 1979

[30] Foreign Application Priority Data

Mar. 31, 1978 [DE] Fed. Rep. of Germany ..... 2813883

[51] Int. Cl.[2] ..... G10D 13/02

[52] U.S. Cl. ..... 84/411 R; 84/413

[58] Field of Search ..... 84/411–417, 84/419–420

[56] References Cited

U.S. PATENT DOCUMENTS

| | | | |
|---|---|---|---|
| 1,391,786 | 9/1921 | Nelson | 84/411 R |
| 2,092,980 | 9/1937 | Ludwig | 84/411 R |
| 2,172,578 | 9/1939 | Gladstone | 84/411 R |
| 4,122,747 | 10/1978 | Toshinori | 84/411 R |

FOREIGN PATENT DOCUMENTS

| | | | |
|---|---|---|---|
| 22329 | of 1905 | United Kingdom | 84/411 A |

*Primary Examiner*—Lawrence R. Franklin

*Attorney, Agent, or Firm*—Norman S. Blodgett; Gerry A. Blodgett

[57] ABSTRACT

Percussion instrument including a tensioning mechanism for the head, comprising a number of threaded bushings mounted about the periphery of the instrument wall, each with a screw adjustable therein acting on a hoop holding the skins; each bushing has on its circumference a tangential slot which a peripheral section of a spring ring engages under tension; each screw has on its shank a peripheral catch surface for that peripheral section of the spring ring which lies in the slot of the bushing.

8 Claims, 4 Drawing Figures

Fig. 1
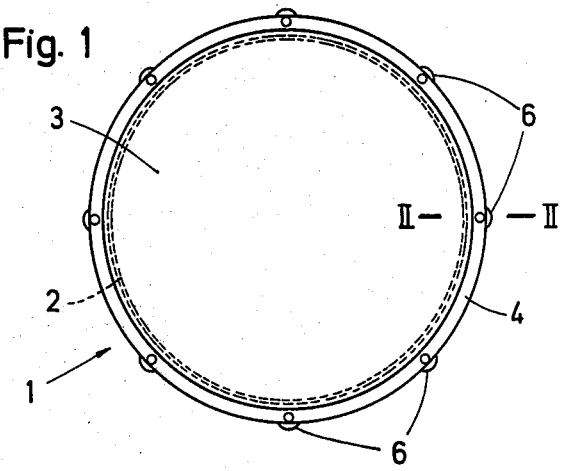
Fig. 2
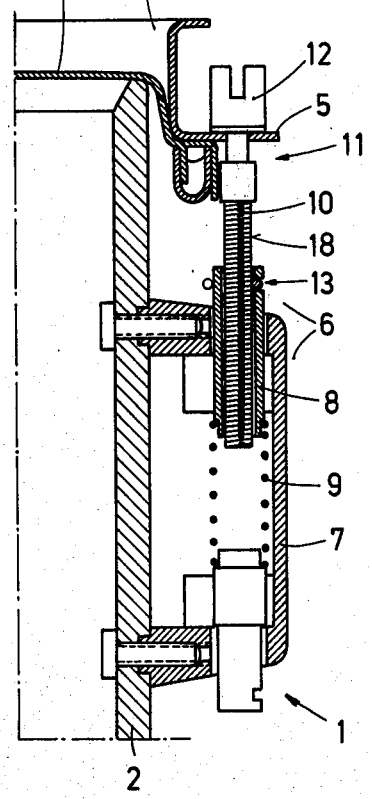
Fig. 3
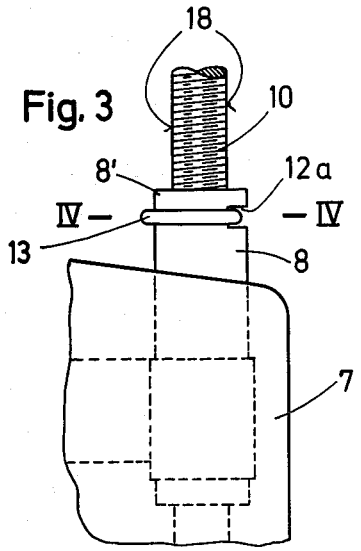
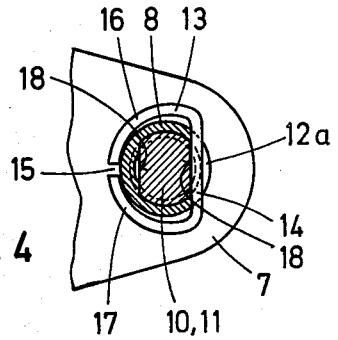
Fig. 4

PERCUSSION INSTRUMENT

BACKGROUND OF THE INVENTION

This invention relates to a tensioning mechanism for the skins of percussion instruments and consists of threaded bushings held in bearing blocks disposed on the periphery of the instrument wall and of screws which are adjustable therein and which also act on the hoop which holds the skin.

Tensioning mechanisms of this type have already been known for a long time. They have also proved satisfactory in those cases where, with the aid thereof, the skins are stretched so as to be tightly drawn with great force over the rim of the instrument wall. On account of the high tension inherent in the skins, a high frictional force is in fact produced between the turns of the screw and the threaded bush and, as a consequence, the self-locking action is strengthened against an unintentional loosening of the screws.

However, the modern forms of music and especially beat music sometimes require loosely-tensioned skins. The low frictional force which results from this between the threads of the screw and the threaded bush does, however, lead to the disadvantage that the screws easily become automatically loosened, whereby the adjusted tension of the skin is lost.

Accordingly, so as to avoid these disadvantages, locking nuts with a peripheral knurling have been associated with the tensioning mechanisms consisting of the threaded bushes and the screws, so as to maintain the position. It is certainly possible by this means to avoid the undesirable loosening of the tensioning screws in the threaded bushes. Nevertheless, the disadvantage which arises from the use of the locking nuts is that, initially, all locking nuts must be loosened for the purpose of a required change in the skin tension before any adjustment of the tensioning screws can be carried out. After making the required adjustment, it is then necessary for all locking nuts to be tightened once again until they are sufficiently tight.

It is quite evident that, when using this known construction of the tensioning mechanisms, intricate and time-wasting manipulations must be carried out to change the head tension.

The present invention seeks to obviated all the disadvantages which are inherent in the known tensioning mechanisms of the type previously described. Accordingly, the invention seeks to provide a tensioning mechanism which permits a direct adjustment of the screws for the purpose of a required variation in the head tension, but in addition also offers a high degree of security against unintentional loosening of the screws in the threaded bushings.

According to this invention, a tensioning mechanism is provided for the head of a percussion instrument, comprising threaded bushings held in bearing blocks disposed on the circumference of the instrument wall and screws which are adjustable in the bushings and which also act on a hoop which holds the head. Each threaded bushing is formed on its circumference with at least one tangential slot in which a peripheral section of a spring ring engages with a selected tension. Each screw is provided on its shank at least one peripheral flat portion or indentation as a catch surface for that peripheral section of the spring ring which lies in the slot of the threaded bush.

It has been found that the cost of manufacture, as compared with the original type of construction of tensioning mechanisms is only slightly increased by the system of the invention is used; it is clearly lower than the cost for tensioning mechanisms which are fitted with locking nuts.

With regard to the tensioning mechanism constructed in accordance with the invention, it has proved to be particularly advantageous that a form-locking arrangement of the screws in the threaded bushings is produced, instead of a connection that is strictly force-locking. The form-locking securing action is capable of being influenced in a particularly favorable manner by providing the spring ring with a peripheral section having a chordal engagement in the slot of the threaded bush.

It is also preferable that the screw be provided on its shank with a plurality of peripheral flat portions, so as to be able to effect a finely graduated variation in the skin tension.

Preferably, the spring ring is formed of wire or strip material to have approximately the form of a triangle which is open at one point. Preferably, those sides of the triangle which adjoin the opening are given a convex curvature.

Preferably, the tangential slot and the spring ring which is latched therein are arranged on that end of the threaded bush which projects from the bearing block toward the hoop.

With these and other objects in view, as will be apparent to those skilled in the art, the invention resides in the combination of parts set forth in the specification and covered by the claims appended hereto.

BRIEF DESCRIPTION OF THE DRAWINGS

The character of the invention, however, may be best understood by reference to one of its structural forms, as illustrated by the accompanying drawings, in which:

FIG. 1 is a plan view of a drum equipped with tensioning mechanisms for the head, FIG. 2 is a vertical sectional view of the drum taken on the view being taken through a tensioning mechanism for the drum and in approximately normal size, FIG. 3 is an enlarged detail view of the tensioning mechanism shown in FIG. 2, and FIG. 4 is a horizontal sectional view taken on the line IV–IV of FIG. 3.

DESCRIPTION OF THE PREFERRED EMBODIMENT

FIG. 1 shows one example of the use of the invention with a drum 1. The drum has an tubular main body with a wall 2 over one end of which is placed the skin or head 3. The said head 3 is fixed at its periphery to a rim or hoop 4, which surrounds the upper end of the wall 2 with a concentric clearance.

Acting on a radial flange 5 of the hoop 4 is a plurality of tensioning mechanisms 6; for example, there are eight such mechanisms according to FIG. 1. These are arranged uniformly around the periphery of the drum 1. Each of these tensioning mechanisms 6 consists of a bearing block 7 which is rigidly connected to the drum wall 2 and in which a threaded bushing 8 is mounted so as to be locked against rotation but so that it can be displaced axially relative to the force of a spring 9. Engaging with this threaded bushing 8 is the shank 10 of a screw 11 whose head 12 is formed with a radial flange 5 provided on the hoop 4.

By turning the screw 11 by means of a suitable tool, the said screw is displaced axially relative to the threaded bushing 8, the effect being that the tension of the head 3 supported on the one end of the drum wall 2 is altered through the hoop 4.

In order that the screw 11 with its stem 10 be incapable of turning unintentionally relative to the threaded bushing and thus of being displaced axially, the threaded bushing 8 is provided in the vicinity of its end 8' (where it projects from the bearing block 7) and on its periphery with a tangential slot 12*a*. In the region of this slot 12*a*, the threaded bushing 8 is embraced by a resilient locking ring 13, in such a way that a certain peripheral section 14 of the ring 13 lies in the slot 12 with a selected tension.

The ring 13 is formed of wire or strip material and has approximately the form of a triangle open at one point. Advantageously, the triangular sides 16 and 17 of the spring ring 13 which are next to the opening 15 have a convexly-curved form, so that a relatively large area of support is provided on the periphery of the threaded bushing 8. The embracing section 14 of the ring 13 is, on the other hand, made straight, so that it is sprung in chordal fashion into the tangential slot 12 of the threaded bushing 8.

The stem 10 of the screw 11 is formed on its circumference with two diametrically-opposite flat indentations or portions 18 which form latching surfaces for the embracing section 14 of the ring 13 which lies in the slot 12 of the threaded bushing.

Because the embracing section 14 of the ring 13 is pressed with a pre-selected force against the circumference of the stem 10 of the screw 11, it forms a latching device with the peripheral flat portions 18 of the screw stem 10. In this manner, the screw 11, after each one-half turn, is held in a form-locking manner in the threaded bushing 8 and is thereby secured against inadvertent twisting. The force of the ring is of such a magnitude that the screw 11 can be turned comparatively easily by means of a tool fitting into the radial slot of its head 12, when an alteration in the tension of the head 3 is to be undertaken.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Percussion instrument including a tensioning mechanism for the head, comprising threaded bushings held in bearing blocks disposed on the circumference of the instrument wall and screws which are adjustable therein which also act on a hoop which holds the head, each threaded bushing being formed on its circumference with at least one tangential slot in which a peripheral section of a spring ring engages with pre-tension, and each screw having on its shank at least one peripheral indentation as a catch surface for the peripheral section of the spring ring which lies in the slot of the threaded bushing.

2. Percussion instrument as recited in claim 1, wherein the said peripheral section of the spring ring engages secantally in the slot of the threaded bushing.

3. Percussion instrument as recited in claim 2, wherein the screw is provided on its shank with a plurality of peripheral flat portions.

4. Percussion instrument as recited in claim 1, wherein two diametrically-opposite peripheral flat portions are provided.

5. Percussion instrument as recited in claim 4, wherein the spring ring is formed of wire material and has approximately the form of a triangle which is open at one point.

6. Percussion instrument as recited in claim 5, wherein those sides of the triangle which adjoin the opening are given a convex curvature.

7. Percussion instrument as recited in claim 6, wherein the tangential slot and the spring ring which is latched therein are arranged on the end of the threaded bush which projects from the bearing block.

8. Percussion instrument, comprising:

(a) a tubular main body having a thin wall, (b) a flexible head down over one end of the body and having a peripheral hoop, (c) a series of interiorly-threaded bushings mounted on the outer surface of the wall of the main body, each bushing having a slot penetrating from its outer surface to its interior, (e) a screw extending from the hoop into threaded engagement with each of the bushings, the screw having an indentation extending along its length, and (f) a resilient lock ring extending around each bushing and having a portion of its periphery lying the slot and engaging the indentation on the screw to inhibit rotation thereof.

* * * * *